US009116472B2

(12) United States Patent
Nakajima et al.

(10) Patent No.: US 9,116,472 B2
(45) Date of Patent: Aug. 25, 2015

(54) IMAGE FORMING APPARATUS

(71) Applicant: FUJI XEROX CO., LTD, Minato-ku, Tokyo (JP)

(72) Inventors: Takaharu Nakajima, Kanagawa (JP); Miho Ikeda, Kanagawa (JP); Koichiro Yuasa, Kanagawa (JP); Yasumitsu Harashima, Kanagawa (JP); Toko Hara, Kanagawa (JP); Aya Kakishima, Kanagawa (JP)

(73) Assignee: FUJI XEROX CO., LTD, Tokyo (JP)

( * ) Notice: Subject to any disclaimer, the term of this patent is extended or adjusted under 35 U.S.C. 154(b) by 0 days.

(21) Appl. No.: 14/472,700

(22) Filed: Aug. 29, 2014

(65) Prior Publication Data

US 2015/0212458 A1 Jul. 30, 2015

(30) Foreign Application Priority Data

Jan. 24, 2014 (JP) ..... 2014-011526

(51) Int. Cl.
*G03G 15/20* (2006.01)
*G03G 15/16* (2006.01)

(52) U.S. Cl.
CPC ..... *G03G 15/1675* (2013.01)

(58) Field of Classification Search
USPC ..... 399/252, 253, 297–299, 303, 310–313; 430/105, 109.1, 137.14
See application file for complete search history.

(56) References Cited

U.S. PATENT DOCUMENTS

2013/0078562 A1* 3/2013 Takahashi et al. ..... 430/105
2013/0252155 A1* 9/2013 Sugitate et al. ..... 430/105

FOREIGN PATENT DOCUMENTS

JP 4820110 B2 11/2011

* cited by examiner

*Primary Examiner* — Hoan Tran
(74) *Attorney, Agent, or Firm* — Sughrue Mion, PLLC

(57) ABSTRACT

An image forming apparatus includes a first image forming portion that forms a toner image on a latent image carrier with a toner containing a flat pigment; and a second image forming portion that forms a toner image on a latent image carrier with a toner not containing the flat pigment. The toner images formed by these image forming portions are transferred to a toner image carrier or a recording medium. The average charge amount per particle of the toner containing the flat pigment is smaller than that of the toner not containing the flat pigment. A transfer width is larger than the particle diameter of the toner containing the flat pigment. A transfer current flowing between the latent image carrier of the second image forming portion and the toner image carrier or the recording medium is higher than or equal to a value required to form an electric field.

9 Claims, 9 Drawing Sheets

$$FI = \frac{2.69 \times (L^*_{15^\circ} - L^*_{110^\circ})^{1.11}}{L^*_{45^\circ}{}^{0.86}}$$

IMAGE FORMING APPARATUS

CROSS-REFERENCE TO RELATED APPLICATIONS

This application is based on and claims priority under 35 USC 119 from Japanese Patent Application No. 2014-011526 filed Jan. 24, 2014.

BACKGROUND

Technical Field

The present invention relates to an image forming apparatus.

SUMMARY

According to an aspect of the invention, there is provided an image forming apparatus including a first image forming portion that forms a toner image on a latent image carrier with a toner containing a flat pigment, and a second image forming portion that forms a toner image on a latent image carrier with a toner not containing the flat pigment. The toner image formed by the first image forming portion and the toner image formed by the second image forming portion are sequentially transferred to a toner image carrier or a recording medium. An average charge amount per particle of the toner containing the flat pigment is smaller than that of the toner not containing the flat pigment. A transfer width, within which the transfer occurs between the latent image carrier of the second image forming portion and the toner image carrier or the recording medium, is set larger than a particle diameter of the toner containing the flat pigment. A transfer current flowing between the latent image carrier of the second image forming portion and the toner image carrier or the recording medium is set higher than or equal to a value required to form an electric field.

BRIEF DESCRIPTION OF THE DRAWINGS

Exemplary embodiment of the present invention will be described in detail based on the following figures, wherein:

FIGS. 8A and 8B are diagrams showing how to measure the transfer width, in which FIG. 8A shows a state before the metallic-color toner is attracted to the photoconductor drum, and FIG. 8B shows a state after the metallic-color toner is attracted to the photoconductor drum;

DETAILED DESCRIPTION

An exemplary embodiment of the present invention will be described below with reference to the drawings. First, the overall configuration and operation of an image forming apparatus will be described. Then, the relevant part of this exemplary embodiment will be described. Note that, in the following description, the "apparatus height direction" is a direction indicated by an arrow H in FIG. 1, the "apparatus width direction" is a direction indicated by an arrow W in FIG. 1. The direction perpendicular to both apparatus height direction and apparatus width direction is the "apparatus depth direction", which is indicated by an arrow D.

Overall Configuration of Image Forming Apparatus

Figure 1:
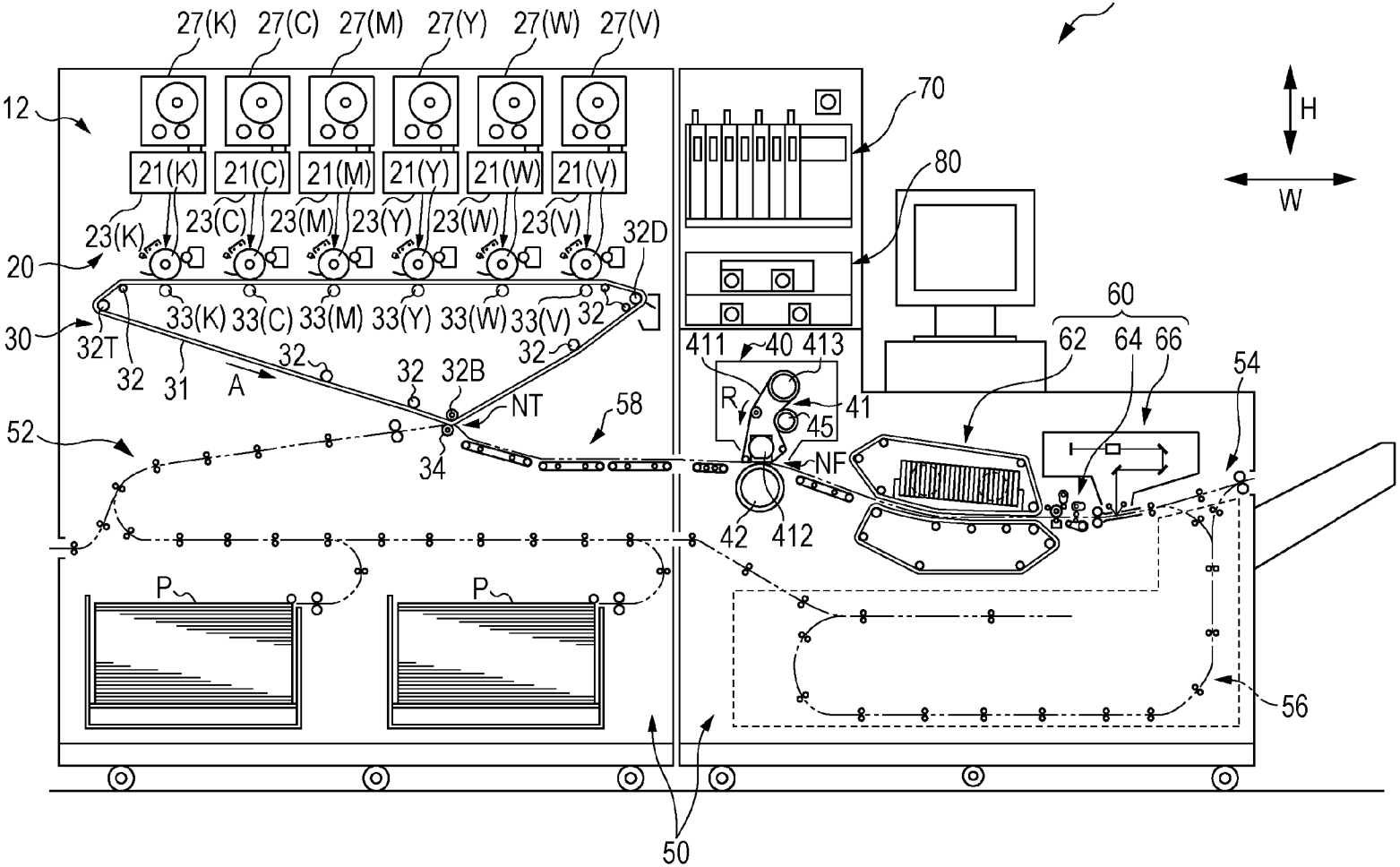
FIG. 1 is a schematic view showing the overall configuration of an image forming apparatus according to this exemplary embodiment.

FIG. 1 is a schematic front view showing the overall configuration of an image forming apparatus 10 according to this exemplary embodiment. As shown in FIG. 1, the image forming apparatus 10 includes an image forming section 12 that forms an image on a sheet member P, serving as an example of a recording medium, using a electrophotographic system; a media transport portion 50 that transports the sheet member P; and a post-processing section 60 that performs post-processing on the sheet member P on which the image has been formed. The image forming apparatus 10 further includes a controller 70 and a power supply unit 80. The controller 70 controls the power supply unit 80 and the aforementioned sections and portions. The power supply unit 80 supplies power to the aforementioned sections and portions, including the controller 70.

Configuration of Image Forming Section

Figure 2:
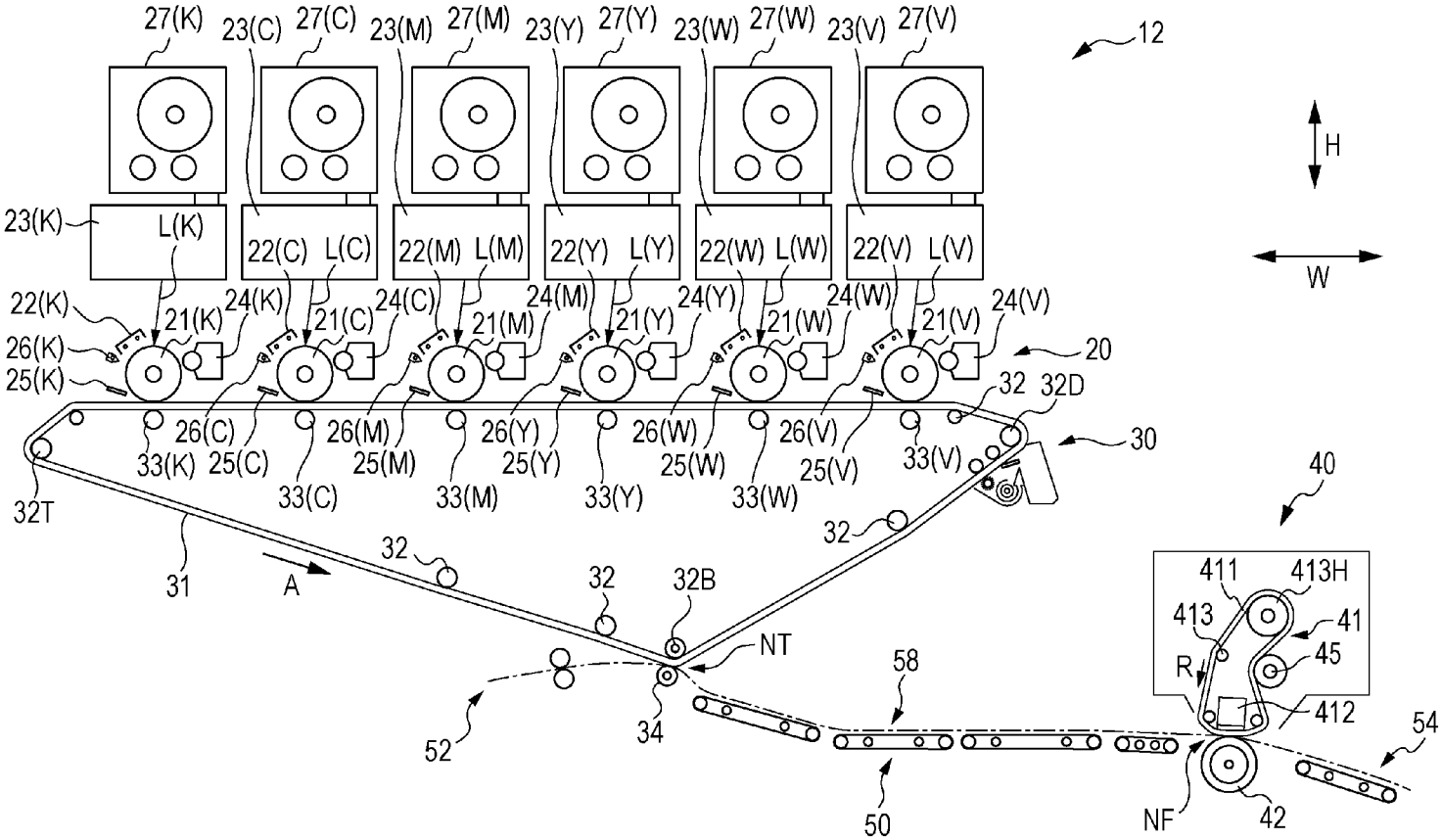
FIG. 2 is a schematic view showing the configuration of an image forming section that constitutes an image forming unit according to this exemplary embodiment.

Referring to FIG. 2, which schematically shows the image forming section 12 from the front, the image forming section 12 will be described. The image forming section 12 includes photoconductor drums 21, serving as an example of a latent image carrier; chargers 22; exposure devices 23; developing devices 24; cleaning devices 25; toner-image forming portions 20 (see also FIG. 3) that form toner images; a transfer device 30 that transfers the toner images formed by the toner-image forming portions 20 to a sheet member P; and a fixing device 40 that fixes the toner image transferred to the sheet member P.

The toner-image forming portions 20 are provided so as to form toner images of the respective colors. In this exemplary embodiment, six toner-image forming portions 20, corresponding to the first special color (V), the second special color (W), yellow (Y), magenta (M), cyan (C), and black (K), are provided. The letters (V), (W), (Y), (M), (C), and (K) suffixed to the reference numerals in FIGS. 1 and 2 indicate the above-mentioned colors. The transfer device 30 transfers toner images of these six colors, first-transferred in a superposed manner to a transfer belt 31 serving as an example of a toner image carrier, to a sheet member P at a transfer nip NT.

In this exemplary embodiment, the first special color (V) is a metallic color used to add metallic shine to an image, whereas the second special color (W) is a color specific to a user, which is more frequently used than the other colors. Toners of the respective colors will be described below.

Photoconductor Drum

Figure 3:
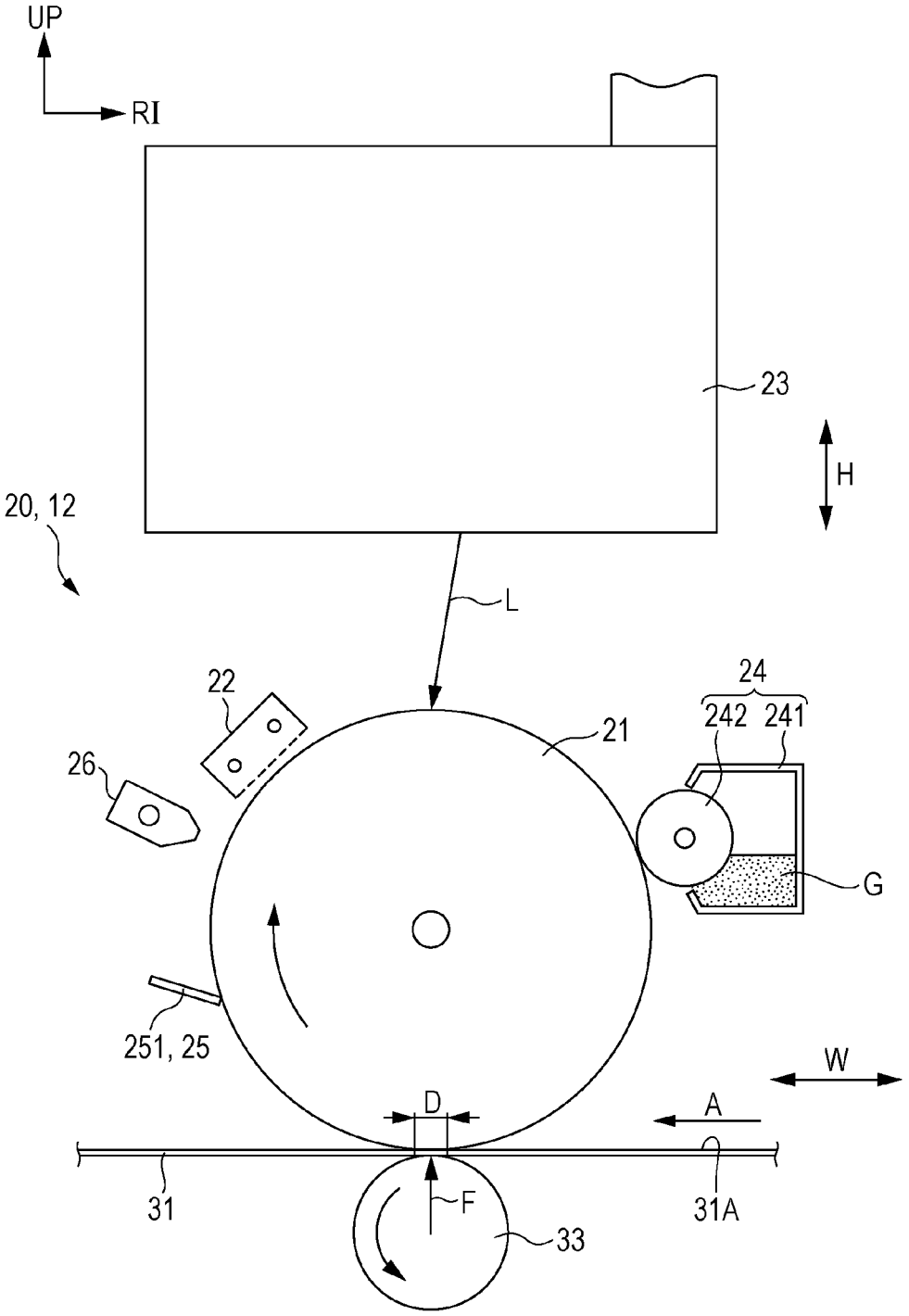
FIG. 3 is a schematic view showing the configuration of a toner-image forming portion that constitutes the image forming unit according to this exemplary embodiment.

As shown in FIGS. 2 and 3, the photoconductor drums 21 are cylindrical and configured to be rotated about their own shafts by driving devices (not shown). The photoconductor drums 21 have, for example, a negatively charged photosensitive layer on the outer circumferential surfaces thereof. The photoconductor drums 21 may also have an overcoat layer on the outer circumferential surfaces thereof. These photoconductor drums 21 corresponding to the respective colors are arranged in a straight line in the apparatus width direction, as viewed from the front.

Charger

The chargers 22 negatively charge the outer circumferential surfaces (photosensitive layers) of the photoconductor drums 21. In this exemplary embodiment, the chargers 22 are scorotron chargers of corona discharge type (non-contact type).

Exposure Device

The exposure devices 23 form electrostatic latent images on the outer circumferential surfaces of the photoconductor drums 21. More specifically, the exposure devices 23 radiate modulated exposure light L (see FIG. 3) to the outer circumferential surfaces of the photoconductor drums 21 that have been charged by the chargers 22, in accordance with image data received from an image-signal processing unit constituting the controller 70. Upon radiation of the exposure light L by the exposure devices 23, electrostatic latent images are formed on the outer circumferential surfaces of the photoconductor drums 21. In this exemplary embodiment, the exposure devices 23 expose the outer circumferential surfaces of the photoconductor drums 21 by scanning laser beams emitted from light sources across the surfaces of the photoconductor drums 21, using light-scanning devices (optical systems) each including a polygon mirror and an Fθ lens. In this exemplary embodiment, the exposure devices 23 are provided for the respective colors.

Developing Device

The developing devices 24 form toner images on the outer circumferential surfaces of the photoconductor drums 21 by developing, with developer G containing toner, the electrostatic latent images formed on the outer circumferential surfaces of the photoconductor drums 21. Although a detailed description will not be given here, the developing devices 24 each include, at least, a container 241 containing the developer G, and a developing roller 242 that supplies the developer G in the container 241 to the photoconductor drum 21 while rotating. Toner cartridges 27 are connected to the containers 241 via supply paths (not shown) for supplying the developer G. The toner cartridges 27 corresponding to the respective colors are arranged side-by-side in the apparatus width direction in front view, above the photoconductor drums 21 and the exposure devices 23, and independently replaceable.

Furthermore, a developing bias voltage is applied to the developing roller 242. The developing bias voltage is a voltage applied between the photoconductor drum 21 and the developing roller 242. By applying the developing bias voltage, an electric potential difference is caused between the developing roller 242 and the photoconductor drum 21, and, as a result, the electrostatic latent image on the photoconductor drum 21 is developed as a toner image.

Cleaning Device

The cleaning devices 25 each include a blade 251 for scraping off the toner remaining on the surface of the photoconductor drum 21 after the toner image has been transferred to the transfer device 30. Although not shown, the cleaning device 25 further includes a housing for storing the toner scraped off with the blade 251 (see FIG. 3), and a transport device for transporting the toner in the housing to a waste toner box.

Transfer Device

The transfer device 30 first-transfers the toner images formed on the respective photoconductor drums 21 to the transfer belt 31 in a superposed manner and second-transfers the superposed toner image to a sheet member P (see FIG. 2).

More specifically, as shown in FIG. 2, the endless transfer belt 31 is wound around multiple rollers 32 so as to be held in a certain position. In this exemplary embodiment, the transfer belt 31 is held so as to form an inverted obtuse triangle shape elongated in the apparatus width direction in front view. Among the multiple rollers 32, a roller 32D shown in FIG. 2 serves as a driving roller that drives the transfer belt 31 in an arrow A direction by using a driving force of a motor (not shown). Furthermore, among the multiple rollers 32, a roller 32T shown in FIG. 2 serves as a tension roller that applies tension to the transfer belt 31. Among the multiple rollers 32, a roller 32B shown in FIG. 2 serves as an opposing roller for a second transfer roller 34.

The transfer belt 31 is in contact with the respective photoconductor drums 21 from below, at the upper side thereof extending in the apparatus width direction in the above-described position. The toner images formed on the respective photoconductor drums 21 are transferred to the transfer belt 31 when transfer bias voltages are applied from first transfer rollers 33. Furthermore, the lower obtuse apex of the transfer belt 31 is in contact with the second transfer roller 34, forming the transfer nip NT. When a transfer bias voltage from the second transfer roller 34 is applied, the transfer belt 31 transfers the toner image thereon to a sheet member P passing through the transfer nip NT.

Fixing Device

As shown in FIG. 2, the fixing device 40 fixes the toner image transferred to the sheet member P in the transfer device 30 onto the sheet member P.

The fixing device 40 fixes the toner image to the sheet member P by applying heat and pressure to the toner image at the fixing nip NF formed between a pressure roller 42 and a fixing belt 411 wound around multiple rollers 413. A roller 413H is a heating roller that has, for example, a built-in heater and is rotated by a driving force transmitted from a motor (not shown). With this configuration, the fixing belt 411 is rotated in an arrow R direction.

Media Transport Portion

The media transport portion 50 includes a media feeding unit 52 that feeds a sheet member P to the image forming section 12, and a media discharge unit 54 that discharges the sheet member P after an image is formed thereon. The media transport portion 50 further includes a media returning unit 56 that is used when images are formed on both sides of a sheet member P, and an intermediate transport portion 58 that transports a sheet member P from the transfer device 30 to the fixing device 40.

The media feeding unit 52 feeds sheet members P on a one-by-one basis to the transfer nip NT in the image forming section 12 in accordance with the timing of transfer. The media discharge unit 54 discharges a sheet member P, onto which a toner image is fixed in the fixing device 40, from the apparatus. When an image is to be formed on the other side of a sheet member P having a toner image fixed to one side thereof, the media returning unit 56 reverses the sheet member P and feeds it back to the image forming section 12 (media feeding unit 52).

Post-Processing Section

As shown in FIG. 1, the post-processing section 60 includes a media cooling unit 62 that cools a sheet member P on which an image has been formed in the image forming section 12, a straightening device 64 that straightens the curled sheet member P, and an image inspection portion 66 that inspects the image formed on the sheet member P. The components of the post-processing section 60 are disposed in the media discharge unit 54 of the media transport portion 50.

The media cooling unit 62, the straightening device 64, and the image inspection portion 66, which constitute the post-processing section 60, are arranged in the media discharge unit 54, in sequence from the upstream side in a sheet-discharge direction, and perform the above-described post-processing on the sheet member P that is being discharged by the media discharge unit 54.

Image Forming Operation

Next, the outline of the image forming and subsequent post-processing processes performed on a sheet member P by the image forming apparatus 10 will be described.

As shown in FIG. 1, upon receipt of an image forming instruction, the controller 70 activates the toner-image forming portions 20, the transfer device 30, and the fixing device 40. As a result, the photoconductor drums 21 and the developing rollers 242 are rotated, and the transfer belt 31 is driven. Furthermore, the pressure roller 42 is rotated, and the fixing belt 411 is driven. The controller 70 further activates the media transport portion 50 etc. in synchronization with the operation of these components.

As a result, the respective photoconductor drums 21 are charged by the chargers 22 while being rotated. Furthermore, the controller 70 sends image data processed in the image-signal processing unit to the respective exposure devices 23. The exposure devices 23 emit exposure light L in accordance with the image data to expose the corresponding charged photoconductor drums 21. As a result, electrostatic latent images are formed on the outer circumferential surfaces of the photoconductor drums 21. The electrostatic latent images formed on the respective photoconductor drums 21 are developed with developer supplied from the developing devices 24. In this way, toner images of the first special color (V), the second special color (W), yellow (Y), magenta (M), cyan (C), and black (K) are formed on the corresponding photoconductor drums 21.

The toner images of the respective colors formed on the corresponding photoconductor drums 21 are sequentially transferred to the running transfer belt 31, when subjected to transfer bias voltages through the corresponding first transfer rollers 33. In this way, a superposed toner image, in which the toner images of six colors are superposed on one another, is formed on the transfer belt 31. The superposed toner image is transported to the transfer nip NT by the running transfer belt 31. The media feeding unit 52 feeds a sheet member P to the transfer nip NT, in accordance with the timing of the transportation of the superposed toner image. By applying a transfer bias voltage at the transfer nip NT, the superposed toner image is transferred from the transfer belt 31 to the sheet member P.

The sheet member P having the toner image transferred thereto is transported from the transfer nip NT in the transfer device 30 to the fixing nip NF in the fixing device 40 by the intermediate transport portion 58, while being subjected to negative-pressure suction. The fixing device 40 applies heat and pressure (fixing energy) to the sheet member P passing through the fixing nip NF. In this way, the toner image transferred to the sheet member P is fixed.

The sheet member P discharged from the fixing device 40 is processed by the post-processing section 60 while being transported to a discharged-media receiving portion outside the apparatus by the media discharge unit 54. The sheet member P heated in the fixing process is first cooled by the media cooling unit 62 and then straightened by the straightening device 64. The toner image fixed to the sheet member P is inspected for the presence/absence and level of toner density defect, image defect, image position defect, etc. by the image inspection portion 66. Finally, the sheet member P is discharged onto the media discharge unit 54.

When an image is to be formed also on a non-image surface (i.e., a surface having no image) of a sheet member P (that is, when two-sided printing is to be performed), the controller 70 switches the transportation path for the sheet member P having gone through the image inspection portion 66 from the media discharge unit 54 to the media returning unit 56. As a result, the sheet member P is reversed and fed to the media feeding unit 52. Then, an image is formed (fixed) on the back surface of the sheet member P through the same image forming process as that performed on the front surface of the sheet member P. The sheet member P then goes through the same post-processing process as that performed on the front surface of the sheet member P after the image formation and is discharged outside the apparatus by the media discharge unit 54.

Configuration of Relevant Part

Toner

Next, the toners according to this exemplary embodiment will be described.

Figure 4:
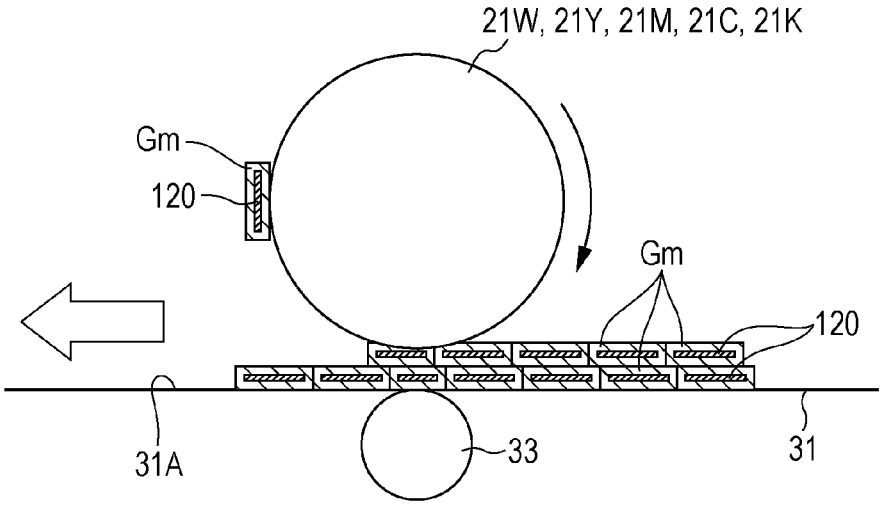
FIG. 4 is a diagram showing a situation in which a portion of metallic-color toner particles transferred to a transfer belt is attracted to a photoconductor drum.
Figure 5:
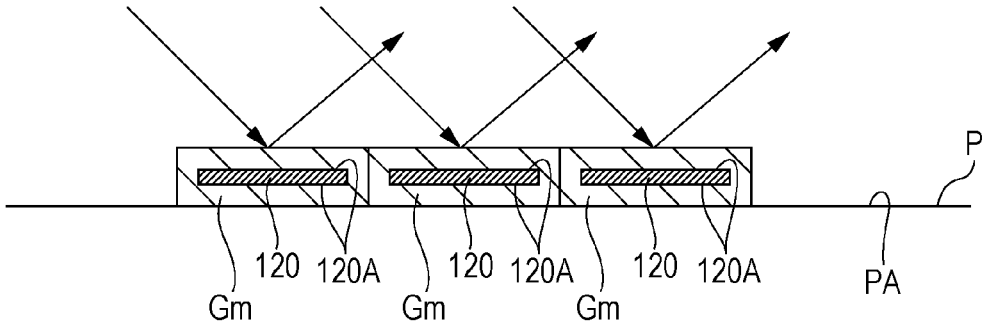
FIG. 5 is a schematic diagram showing that the thickness of a layer of the metallic-color toner particles is small and that reflection surfaces of flat pigment particles have an ideal orientation in which they are arrayed parallel to the plane of the sheet member without overlapping each other.

As shown in FIG. 5, the overall shape of a toner particle Gm of a metallic color (hereinbelow, "metallic-color toner particle Gm"), which is used as the first special color (V), is a flat disc shape. The metallic-color toner particle Gm is composed of a binder resin, such as styrene-acrylic resin, and a flake-like flat pigment particle 120, a charge control agent (not shown), etc. internally added thereto. In FIG. 5 (as well as in FIGS. 4 and 6 described below), the metallic-color toner particles Gm are schematically illustrated in a rectangular shape.

Figure 9A:
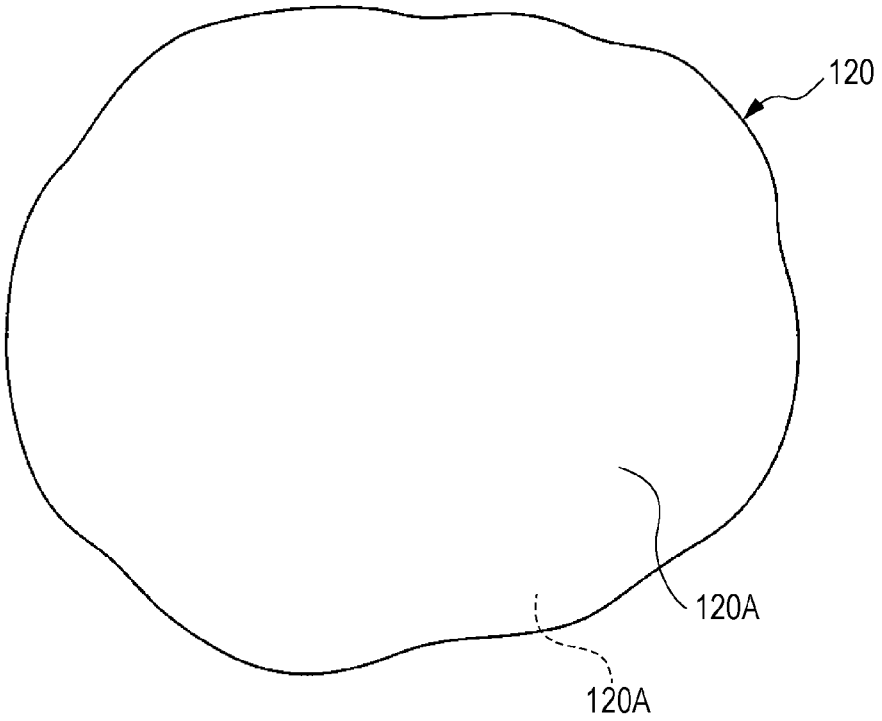
FIG. 9A is a plan view of a flat pigment particle constituting the metallic-color toner particle.
Figure 9B:
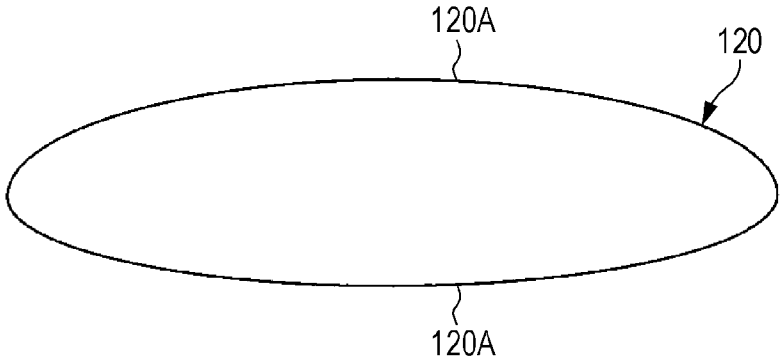
FIG. 9B is a side view of the same.

As shown in FIGS. 9A and 9B, the flat pigment particle 120 according to this exemplary embodiment is composed of flake-like flat aluminum. More specifically, when viewed from a side, the flat pigment particle 120 disposed on a flat surface has a flat shape that is larger in the left-right direction than in the top-bottom direction. Furthermore, the flat pigment particle 120 has a pair of reflection surfaces (flat surfaces) 120A facing up and down in FIG. 9B.

When viewed from above, the pigment particle 120 shown in FIG. 9B has a broader shape, as shown in FIG. 9A, than the shape as viewed from a side.

By reflecting light at the reflection surfaces 120A of the flat pigment particles 120 contained in the metallic-color toner particles Gm, the metallic shine is added to an image.

On the other hand, toner particles Gc of the colors other than the metallic color (hereinbelow, "the other-color toner particles Gc") (not shown), which are used as the second special color (W), yellow (Y), magenta (M), cyan (C), and black (K), have a substantially ball or potato shape and are each composed of a binder resin, such as styrene-acrylic resin, and a pigment (not shown) other than the flat pigment, a charge control agent, etc. internally added thereto. Note that the other-color toner particles Gc do not necessarily have to have a substantially ball or potato shape, but may have various shapes, such as ground toner.

The average charge amount per particle of the metallic-color toner particle Gm containing the flat pigment particle 120 is set smaller than that of the other-color toner particle Gc not containing the flat pigment particle 120.

More specifically, when the average charge amount per particle of the metallic-color toner particle Gm containing the flat pigment particle 120 and that of the other-color toner particle Gc not containing the flat pigment particle 120, measured using a known measuring technique, under the same measuring conditions, are compared with each other, the average charge amount per particle of the metallic-color toner particle Gm containing the flat pigment particle 120 is set smaller than that of the other-color toner particle Gc not containing the flat pigment particle 120. Note that, in this exemplary embodiment, the average charge amount per particle of the metallic-color toner particle Gm containing the flat pigment particle 120 is −0.6 (fc/μm), and the average charge amount per particle of the other-color toner particle Gc not containing the flat pigment particle 120 is −0.4 (fc/μm).

The average charge amount per particle of toner may be obtained by using a known technique. For example, the average charge amount per particle of toner may be measured using a charge-amount-distribution measuring apparatus (E-SPART ANALYZER), manufactured by Hosokawa Micron Corporation. Alternatively, the charge amount may be calculated by measuring the charge amount per unit mass using a blow-off measuring apparatus, and from the mass per toner particle (mass=toner volume×toner specific gravity). In this exemplary embodiment, E-SPART is used.

Furthermore, the charge amount of the toner may be adjusted by using a known technique. For example, the adjustment is possible by employing a toner-design technique, which handles the type, amount, etc. of a charge control agent internally added to the toner.

Furthermore, the average particle diameter (volume average) of the metallic-color toner particles Gm containing the flat pigment particles 120 is set larger than that of the other-color toner particles Gc not containing the flat pigment particles 120.

Moreover, the average particle diameter of the metallic-color toner particles Gm containing the flat pigment particles 120 is set from 6 μm to 15 μm.

The average particle diameter of the toner may be measured using the above-mentioned charge-amount-distribution measuring apparatus (E-SPART ANALYZER) manufactured by Hosokawa Micron Corporation, Multisizer manufactured by Beckman Coulter, Inc., or the like.

First Transfer Conditions

As shown in FIG. 3, a transfer width D, within which the transfer occurs between each of the photoconductor drums 21W, 21Y, 21M, 21C, and 21K of the toner-image forming portions 20W, 20Y, 20M, 20C, and 20K corresponding to the second special color (W), yellow (Y), magenta (M), cyan (C), and black (K), except for the first special color, and the transfer belt 31, is determined such that the transfer is possible therein. Hence, the transfer width D is greater than or equal to the diameter of the toner particle and is smaller than or equal to the diameter of the photoconductor drums 21. Accordingly, the transfer width D is 5 μm or more. In this exemplary embodiment, the transfer width D is set to 4.0 mm. Note that the "transfer width" will be described below.

Furthermore, the transfer current flowing between the transfer belt 31 and each of the photoconductor drums 21W, 21Y, 21M, 21C, and 21K when a transfer bias voltage (DC current) is applied to the corresponding first transfer roller 33 is set to 1.0 μA or more, which is a current required to form an electric field. Note that, in this exemplary embodiment, the transfer current is set to 45 μA.

Furthermore, the transfer load F between the transfer belt 31 and each of the photoconductor drums 21W, 21Y, 21M, 21C, and 21K, i.e., the load with which the transfer belt 31 is urged to each of the photoconductor drums 21W, 21Y, 21M, 21C, and 21K by the corresponding first transfer roller 33, is set to 1 N or more. Note that, in this exemplary embodiment, the transfer load F is set to 13 gf/cm.

Furthermore, the center-plane surface roughness average (Sra) of a belt surface 31A of the transfer belt 31 is set to 0.5 μm or less, taking the particle diameter of the toner and the transfer efficiency into consideration. Note that, in this exemplary embodiment, the center-plane surface roughness average (Sra) is set to 0.040 μm. The center-plane surface roughness average (Sra) is measured by using Surfcom 1400D-12. The center-plane surface roughness average (SRa) is the average roughness at the central plane (reference plane) when a surface roughness curve is approximated by a sine curve. The center-plane surface roughness average (SRa) is obtained by measuring the heights at the respective points using a stylus three-dimensional surface-roughness measuring apparatus and then analyzing the measured values using a three-dimensional surface-roughness analyzing apparatus.

Transfer Width

The "transfer width", mentioned above, is a width different from a so-called nip width, and a method of measuring the transfer width will be described below.

Figure 8A:
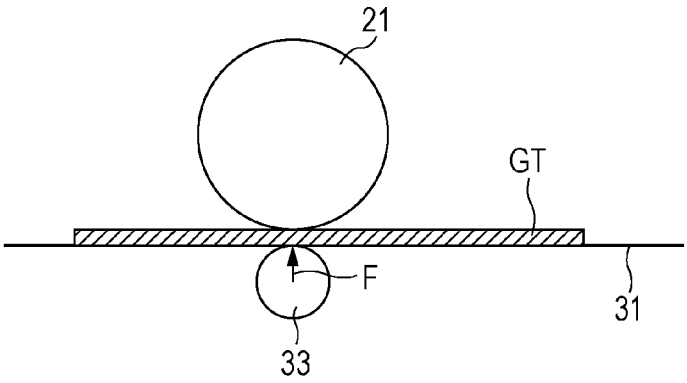
Figure 8B:
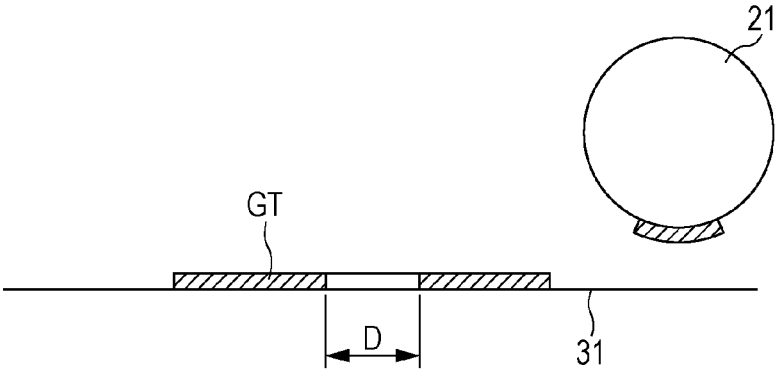

As shown in FIGS. 8A and 8B, a toner image GT is formed on the transfer belt 31, and the first transfer roller 33 is caused to press the transfer belt 31 against the photoconductor drum 21 with the same load as the transfer load F, with which the transfer belt 31 presses the photoconductor drum 21. Next, a bias voltage of an opposite polarity to the toner is applied to the photoconductor drum 21, and then the application of the bias voltage is stopped.

Then, the transfer belt 31 is taken out to observe the toner image GT. The width of a portion where the thickness of the toner layer is reduced (i.e., a portion where the intensity of color is reduced) due to the application of the bias voltage that causes a portion of the toner image GT to be transferred to and attracted to the photoconductor drum 21, is the transfer width D.

Loss Rate

The loss rate will be described with reference to FIGS. 10A and 10B. For ease of understanding, in FIGS. 10A and 10B, the toner is illustrated on a larger scale than the actual size.

Figure 10A:
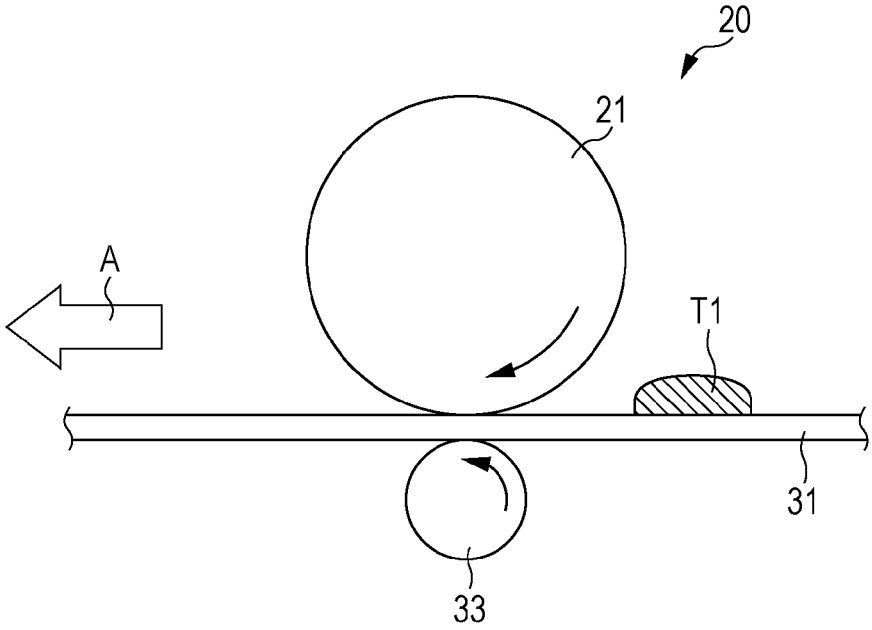
FIG. 10A is a schematic diagram showing the toner on the transfer belt after first transfer.
Figure 10B:
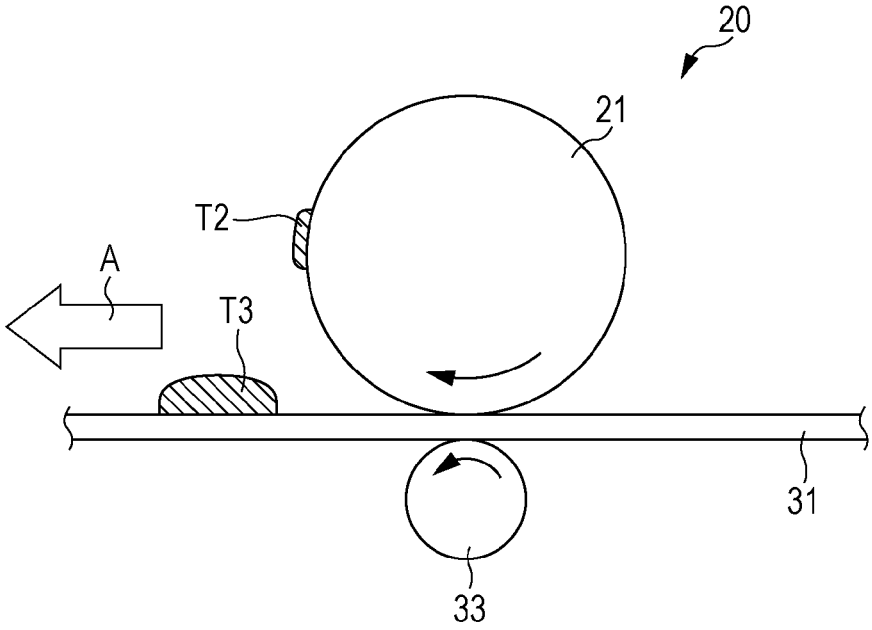
FIG. 10B is a schematic diagram showing the toner on the transfer belt after passing a first transfer on the downstream side and the toner attracted to the photoconductor drum.

As shown in FIGS. 10A and 10B, when toner T1 (FIG. 10A) transferred to the transfer belt 31 in the first transfer comes into contact with the photoconductor drum 21 of the toner-image forming portion 20 on the downstream side, a portion thereof (toner T2) is attracted to the photoconductor drum 21.

Note that a phenomenon in which the metallic-color toner particles Gm and the other-color toner particles Gc transferred to the transfer belt 31 are attracted to the photoconductor drums 21W, 21Y, 21M, 21C, or 21K (i.e., retransfer) will be described below.

Where M1 is the mass of the toner T1 transferred to the transfer belt 31 in the first transfer, and M2 is the mass of the toner T2, which is a portion of the toner T1 that came into contact with and attracted to the photoconductor drum 21 of the toner-image forming portion 20 on the downstream side, the loss rate S (%) is calculated from: (M2/M1)×100.

Furthermore, where Sm is the loss rate of the metallic-color toner Gm used as the first special color (V), and Sc is the loss rate of the toner used as the second special color (W), yellow (Y), magenta (M), and cyan (C), the relationship between Sm and Sc is set as: Sm>Sc.

Although any method may be employed to satisfy Sm>Sc, in this exemplary embodiment, as described above, Sm>Sc is satisfied by setting the average charge amount per particle of the metallic-color toner particle Gm containing the flat pigment particle 120 smaller than that of the other-color toner particle Gc not containing the flat pigment particle 120.

Alternatively, Sm>Sc may be satisfied by controlling the transfer bias current to be applied between the transfer belt 31 and each of the photoconductor drums 21W, 21Y, 21M, 21C, and 21K of the toner-image forming portions 20W, 20Y, 20M, 20C, and 20K corresponding to the second special color (W), yellow (Y), magenta (M), cyan (C), and black (K), other than the first special color (V).

Note that the transfer conditions, more specifically, the above-described transfer width D, transfer current, and transfer load F, in this exemplary embodiment are determined to satisfy Sm>Sc.

Method of Measuring Loss Rate

Example of Measurement of Mass M1 of First-Transferred Toner T1

The toner T1 first-transferred to the transfer belt 31 is vacuumed and collected by a filter. The mass M1 of the toner T1 collected by the filter is measured using an electric balance.

Example of Measurement of Mass M2 of Toner T2 Attracted to Photoconductor Drum First Method The mass of toner T3 that has passed the photoconductor drum 21 of the toner-image forming portion 20 on the downstream side without being attracted thereto is denoted by M3. The toner T3 on the transfer belt 31 is vacuumed and collected by a filter, and the mass M3 is measured using an electric balance.

Because the mass M2 of the toner T2, brought into contact with and attracted to the photoconductor drum 21, is obtained from:

$$M1-M3=M2,$$

Sm and Sc are calculated from:

$$((M1-M3)/M1)\times 100=S(\text{loss rate }(\%)).$$

However, because the mass M2 of the toner T2 brought into contact with and attracted to the photoconductor drum 21 is much smaller than the mass M1 of the toner T1 and the mass M3 of the toner T3 on the transfer belt 31, there is a large measurement error.

Second Method

The mass M2 of the toner M2 attracted to the photoconductor drum 21 is measured (the method of measuring the mass will be described below). Then, Sm and Sc are calculated from:

$$(M2/M1)\times 100=S(\text{loss rate }(\%)).$$

As has been described above, because the mass M2 of the toner T2 attracted to the photoconductor drum 21 is very small, precise measurement thereof is difficult. Hence, another method of obtaining precise mass M2 will be described below, as an example.

Under predetermined conditions, the toner T2 on the photoconductor drum 21 is vacuumed and collected by a filter, and the mass M2 of the toner T2 is measured. Note that, as has been described above, because the mass M2 is very small and, hence, involves many measurement errors (variations), the number of measurements (N number) is increased, and the results are averaged.

The toner T2 attracted to the photoconductor drum 21 under the same conditions is transferred to a piece of tape, which is then applied to a board to measure the color.

The average of the mass M2 measured under several conditions and the color transferred to a piece of tape are correlated with each other, and a regression expression (regression line) is generated. Then, using this regression expression, the mass M2 of the toner T2 is obtained only by measuring the color of a piece of tape to which the toner T2 attracted to the photoconductor drum 21 is transferred.

In the case of the second special color (W), yellow (Y), magenta (M), and cyan (C), a piece of tape to which the toner T2 is transferred is applied to a white board to measure the image density (ID).

In the case of the metallic-color toner particles Gm containing the flat pigment particles 120, a piece of tape to which the toner T2 is transferred is applied to a black board to measure L*.

Advantages

Next, the operation of the relevant part configuration will be described.

When an image forming instruction to give metallic shine to at least a portion of an image is issued (in a mode in which the metallic shine is given to at least a portion of an image), as shown in FIG. 1, the toner-image forming portion 20V corresponding to the metallic color (i.e., an example of a first image forming portion) is operated in the same way as the toner-image forming portions 20W, 20Y, 20M, 20C, and 20K corresponding to the other colors (i.e., examples of a second image forming portion).

More specifically, an electrostatic latent image corresponding to a portion where the metallic shine is given to an image is formed on the surface of the photoconductor drum 21V. That is, when the metallic shine is to be given to the entire image (sheet member P), the electrostatic latent image is formed on the entire surface of the photoconductor drum 21V, whereas when the metallic shine is to be given to a portion of the image (sheet member P), the electrostatic latent image corresponding to that portion is formed.

The electrostatic latent image formed on the photoconductor drum 21V is developed with the developer, containing the metallic-color toner particles Gm (see FIG. 4, etc.), supplied from the developing device 24V. In this way, a metallic-color toner image is formed on the photoconductor drum 21V.

This metallic-color toner image is transferred to the running transfer belt 31, and subsequently, the other-color toner images are sequentially transferred to the transfer belt 31. In this way, a superposed toner image, in which the toner images of six colors are superposed on one another, is formed on the transfer belt 31. This superposed toner image is transferred from the transfer belt 31 to a sheet member P at the transfer nip NT.

Next, a phenomenon in which the metallic-color toner particles Gm transferred to the transfer belt 31 are attracted to the photoconductor drums 21W, 21Y, 21M, 21C, and 21K (i.e., retransfer) will be described below with reference to FIG. 4. In FIG. 4, the metallic-color toner particles Gm are illustrated on a larger scale than the actual size.

Although the following description will be given by taking the metallic-color toner particles Gm as an example, the same description applies to the second special color (W), yellow (Y), magenta (M), cyan (C), and black (K).

As shown in FIG. 4, a toner image formed with the metallic-color toner particles Gm and transferred to the transfer belt 31 comes into contact with the photoconductor drums 21W, 21Y, 21M, 21C, and 21K of the toner-image forming portions 20W, 20Y, 20M, 20C, and 20K corresponding to the second special color (W), yellow (Y), magenta (M), cyan (C), and black (K). At this time, due to the transfer bias voltages applied to the first transfer rollers 33, an electric charge having an opposite polarity to the metallic-color toner particles Gm is injected into the metallic-color toner particles Gm, reversing the polarity of the metallic-color toner particles Gm and causing the metallic-color toner particles Gm to be attracted to the photoconductor drums 21W, 21Y, 21M, 21C, and 21K. The metallic-color toner particles Gm are attracted particularly to the photoconductor drum 21W.

Because the attractive force between the metallic-color toner particles Gm is smaller than the attractive force between the transfer belt 31 and the metallic-color toner particles Gm, the metallic-color toner particles Gm on the upper layer (in FIG. 4) are preferentially attracted to the photoconductor drums 21.

Due to the metallic-color toner particles Gm on the upper layer being attracted to the photoconductor drums 21W, 21Y, 21M, 21C, and 21K, the thickness of the toner layer composed of the metallic-color toner particles Gm on the transfer belt 31 decreases (the number of layers decreases).

Figure 6:
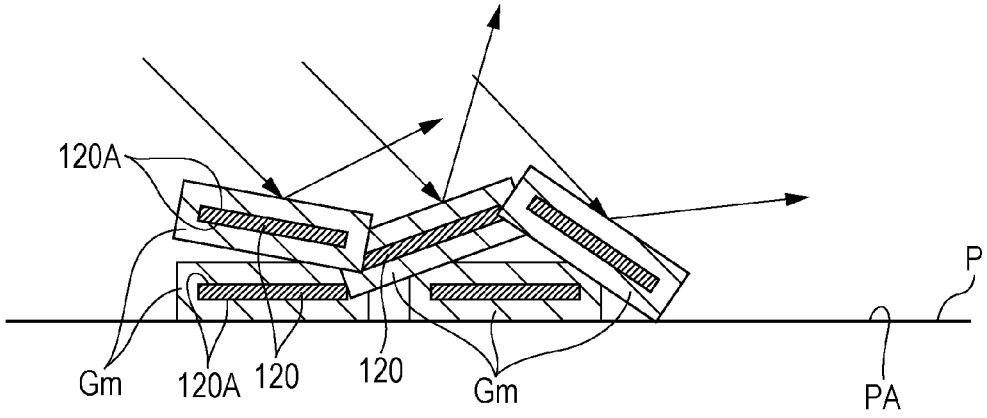
FIG. 6 is a schematic diagram showing that the thickness of the layer of the metallic-color toner particles is large and that the flat pigment particles are in an orientation in which the reflection surfaces thereof randomly face directions intersecting a direction parallel to the plane of the sheet member.

Herein, the metallic shine (i.e., the dependence of reflectance on angle) of the metallic-color toner particles Gm will be described. FIGS. 5 and 6 schematically show toner images formed with the metallic-color toner particles Gm, fixed to the sheet member P. Although the metallic-color toner particles Gm are fused together in actuality, they are illustrated in a separate manner in FIGS. 5 and 6 for ease of understanding. Furthermore, the other-color toner particles Gc are not shown.

Figure 7:
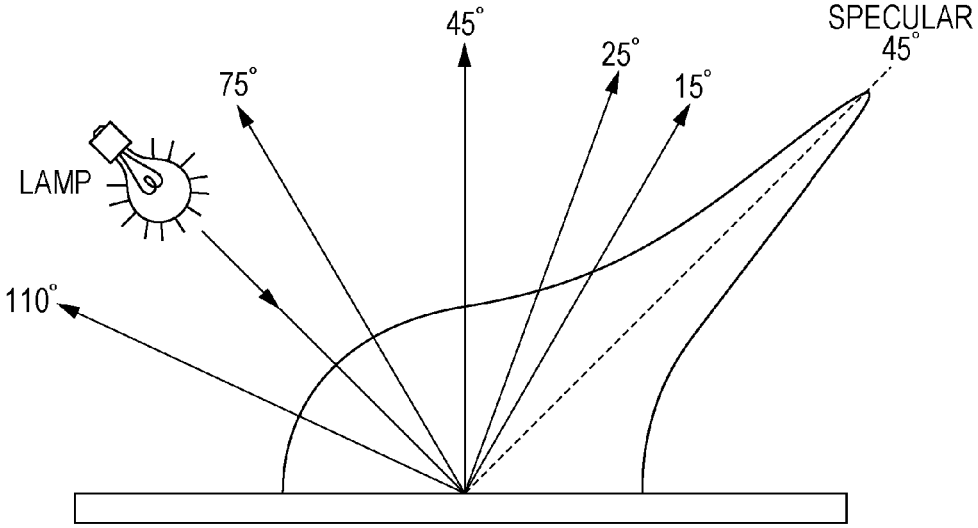
FIG. 7 is an expression for calculating flop index.

In order to enhance the metallic shine with the metallic-color toner particles Gm, it is necessary that the flop index (FI) value shown in FIG. 7 is increased; that is, it is necessary that the regular reflectance ($L^*_{15°}$) is increased, and the diffuse reflectance ($L^*_{100°}$) is reduced.

More specifically, as shown in FIG. 5, when the thickness, Am, of a toner layer composed of the metallic-color toner particles Gm is small (i.e., when the product of the thickness of each toner particle times the number of layers is small), and moreover, when the thickness of the toner layer is small (i.e., when the number of layers is close to one), the orientation characteristics of the toner particles are high. Hence, the reflection surfaces 120A of the flat pigment particles 120 are likely to have an ideal orientation in which they are arrayed parallel to a plane PA of the sheet member P without overlapping each other. In this ideal orientation in which the reflection surfaces 120A of the flat pigment particles 120 are arrayed parallel to the plane PA of the sheet member P without overlapping each other, light is reflected in the same direction, increasing the regular reflectance ($L^*_{15°}$) and reducing the diffuse reflectance ($L^*_{110°}$). Consequently, the metallic shine is enhanced (the flop index value increases).

However, as shown in FIG. 6, when the thickness, Am, of the toner layer composed of the metallic-color toner particles Gm is large (i.e., when the number of layers is large), the orientation characteristics of the toner particles are low. Hence, the reflection surfaces 120A of the flat pigment particles 120 are likely to have an orientation in which they face various directions intersecting a direction parallel to the plane PA of the sheet member P while overlapping one another. When the reflection surfaces 120A of the flat pigment particles 120 face various directions intersecting a direction parallel to the plane PA of the sheet member P while overlapping one another, light is reflected in random directions, reducing the regular reflectance ($L^*_{15°}$) and increasing the diffuse reflectance ($L^*_{110°}$). Consequently, the metallic shine is reduced (the flop index value decreases).

In this exemplary embodiment, as described above, due to the metallic-color toner particles Gm containing the flat pigment particles 120 being attracted to the photoconductor drums 21W, 21Y, 21M, 21C, and 21K, the thickness of the toner layer composed of the metallic-color toner particles Gm, formed on the transfer belt 31, decreases (see FIG. 4).

In this exemplary embodiment, the average charge amount per particle of the metallic-color toner particle Gm containing the flat pigment particle 120 is set smaller than that of the other-color toner particle Gc not containing the flat pigment particle 120. Therefore, the metallic-color toner particles Gm are more likely to be reversed in polarity, due to the injection of an electric charge having an opposite polarity, than the other-color toner particles Gc and are likely to be attracted to the photoconductor drums 21. That is, compared with a case where the average charge amount per particle of the metallic-color toner particle Gm is greater than or equal to that of the other-color toner particle Gc, the thickness of the toner layer composed of the metallic-color toner particles Gm, formed on the transfer belt 31, is small.

Note that the transfer width D, within which the transfer occurs between the transfer belt 31 and the photoconductor drums 21, is set greater than or equal to the diameter of the metallic-color toner particles Gm, and the transfer current flowing between the transfer belt 31 and each of the photoconductor drums 21 is set greater than or equal to a value required to form an electric field. Furthermore, the transfer width D is set greater than or equal to 5 μm, and the transfer current is set greater than or equal to 1.0 μA. These settings are to facilitate reversing of the polarity of the metallic-color toner particles Gm due to the injection of an electric charge having an opposite polarity.

This will be described from a different perspective: that is, the flat pigment particles 120 contained in the metallic-color toner particles Gm are caused to be attracted to the photoconductor drums 21 such that they have the ideal orientation shown in FIG. 5, thereby reducing the thickness of the toner layer composed of the metallic-color toner particles Gm, formed on the transfer belt 31, to enhance the metallic shine.

Furthermore, the average particle diameter of the metallic-color toner particles Gm containing the flat pigment particles 120 is greater than that of the other-color toner particles Gc not containing the flat pigment particles 120. Because the metallic-color toner particles Gm containing the flat pigment particles 120 are large in size and surface area and flat in shape, the contact area between the transfer belt 31 and the metallic-color toner particles Gm is large. Hence, the mechanical attractive force between the transfer belt 31 and the metallic-color toner particles Gm is large.

However, if the diameter of the metallic-color toner particles Gm is too small, the attractive force between the metallic-color toner particles Gm increases, and if the diameter of the metallic-color toner particles Gm is too large, the mass per toner particle increases, making the toner particles less likely to be attracted to the photoconductor drums 21. Accordingly, in this exemplary embodiment, the average diameter of the metallic-color toner particles Gm is set to 6 μm to 15 μm.

Furthermore, the transfer load acting between the photoconductor drums 21 and the transfer belt 31 is set to 1 N or more, and the center-plane surface roughness average (Sra) of the belt surface 31A of the transfer belt 31 is set to 0.5 μm or less. Accordingly, the mechanical attractive force between the metallic-color toner particles Gm and the transfer belt 31 increases.

In this manner, because the metallic-color toner particles Gm on the upper layer are controlled such that they are likely to be attracted to the photoconductor drums 21, the thickness of the toner layer composed of the metallic-color toner particles Gm, formed on the transfer belt 31, is more effectively reduced.

On the other hand, the relationship between Sm and Sc is designed as: Sm>Sc, where Sm is the loss rate of the metallic-color toner particles Gm, which is used as the first special color (V); and Sc is the loss rate of the toner used as the second special color (W), yellow (Y), magenta (M), cyan (C), and black (K).

Therefore, as shown in FIG. 4, a large amount of metallic-color toner particles Gm containing the flat pigment particles 120 is attracted to the photoconductor drums 21W, 21Y, 21M, 21C, and 21K, and, as a result, the thickness of the toner layer composed of the metallic-color toner particles Gm, formed on the transfer belt 31, decreases. Consequently, the amount of flat pigment particles 120 in such an orientation that deteriorates the metallic shine, as those illustrated in FIG. 6, decreases, which increases the proportion of the flat pigment particles 120 in an ideal orientation as described above with reference to FIG. 5. As a result, the metallic shine increases.

Based on the common technical knowledge of the electrophotography, because the toner T3 on the transfer belt 31 (see FIG. 10B) will eventually be fixed to the recording medium P to become an image, it is thought to be desirable that the amount of the toner T3 be large, from the standpoint of the image quality (image density etc.). Furthermore, because the toner T2 attracted to the photoconductor drums 21 (see FIG. 10B) will eventually be discarded, it is thought to be desirable that the amount of the toner T2 be small. That is, it is desirable that the loss rate, Sc, of the second special color (W), yellow (Y), magenta (M), cyan (C), and black (K) be small.

In contrast, as described above with reference to FIG. 5, the smaller the thickness, Am (thickness of toner×number of layers), of the layer of the metallic-color toner Gm used as the first special color (V) (the smaller the number of layers), and moreover, the smaller the thickness of the toner layer (the closer to one layer), the higher the metallic shine is (the flop index value increases). Accordingly, it is desirable that the amount of the toner T3 on the transfer belt 31 (see FIG. 10B) be small and that the amount of the toner T2 attracted to the photoconductor drums 21 (see FIG. 10B) be large. That is, it is desirable that the loss rate, Sm, of the metallic-color toner Gm be large.

By setting the loss rate, Sc, of the second special color (W), yellow (Y), magenta (M), cyan (C), and black (K) and the loss rate, Sm, of metallic-color toner particles Gm containing the flat pigment particles 120, which are contrary to each other, such that Sm>Sc is satisfied, both the image quality of the second special color (W), yellow (Y), magenta (M), cyan (C), and black (K) and the image quality (metallic shine) of the metallic-color toner G, used as the first special color (V), are ensured.

The present invention is not limited to the above-described exemplary embodiment.

Note that, although a specific exemplary embodiment of the present invention has been described in detail above, the present invention is not limited to such an exemplary embodiment, and it is obvious for those skilled in the art that the present invention may have various other exemplary embodiments within a scope of the present invention. For example, in the above-described exemplary embodiment, although a case where toner images of the respective colors are individually transferred to the transfer belt 31 has been described as an example, the toner images of the respective colors may be individually and directly transferred to a sheet member P (recording medium), or the toner images of the respective colors may be collectively transferred to the transfer belt or the sheet member P (recording medium).

Furthermore, although a metallic-color toner image and the other-color toner images are simultaneously fixed to a sheet member P in the above-described exemplary embodiment, fixing of the metallic-color toner image onto the sheet member P and fixing of the other-color toner images onto the sheet member P may be performed separately.

The foregoing description of the exemplary embodiment of the present invention has been provided for the purposes of illustration and description. It is not intended to be exhaustive or to limit the invention to the precise forms disclosed. Obviously, many modifications and variations will be apparent to practitioners skilled in the art. The embodiment was chosen and described in order to best explain the principles of the invention and its practical applications, thereby enabling others skilled in the art to understand the invention for various embodiments and with the various modifications as are suited to the particular use contemplated. It is intended that the scope of the invention be defined by the following claims and their equivalents.

What is claimed is:

1. An image forming apparatus comprising:

a first image forming portion that forms a toner image on a latent image carrier with a toner containing a flat pigment; and a second image forming portion that forms a toner image on a latent image carrier with a toner not containing the flat pigment, wherein:

the toner image formed by the first image forming portion and the toner image formed by the second image forming portion are sequentially transferred to a toner image carrier or a recording medium;

an average charge amount per particle of the toner containing the flat pigment is smaller than that of the toner not containing the flat pigment;

a transfer width, within which the transfer occurs between the latent image carrier of the second image forming portion and the toner image carrier or the recording medium is set larger than a particle diameter of the toner containing the flat pigment; and a transfer current flowing between the latent image carrier of the second image forming portion and the toner image carrier or the recording medium is set higher than or equal to a value required to form an electric field.

2. The image forming apparatus according to claim 1, wherein an average particle diameter of the toner containing the flat pigment is larger than that of the toner not containing the flat pigment.

3. The image forming apparatus according to claim 1, wherein the average particle diameter of the toner containing the flat pigment is from approximately 6 μm to approximately 15 μm.

4. The image forming apparatus according to claim 1, wherein the toner image carrier is an endless belt; and a center-plane surface roughness average of a surface of the toner image carrier is approximately 0.5 μm or less.

5. The image forming apparatus according to claim 1, wherein a transfer load acting between the latent image carrier of the second image forming portion and the toner image carrier is set to approximately 1 N or more.

6. The image forming apparatus according to claim 1, wherein the transfer width is set to approximately 5 μm or more.

7. The image forming apparatus according to claim 1, wherein the transfer current is set to approximately 1.0 μA or more.

8. An image forming apparatus comprising:

a first image forming portion that forms a toner image on a latent image carrier with a toner containing a flat pigment; and a second image forming portion that forms a toner image on a latent image carrier with a toner not containing the flat pigment, wherein:

the toner image formed by the first image forming portion and the toner image formed by the second image forming portion are sequentially transferred to a toner image carrier or a recording medium; and a relationship represented by Sm>Sc is satisfied, where, when a loss rate is represented by M2/M1, in which M1 is a mass of the toner transferred to the toner image carrier or the recording medium, and M2 is a mass of a portion of the toner transferred to the toner image carrier and then attracted to the latent image carrier on a downstream side, Sm is the loss rate of the toner containing the flat pigment, and Sc is the loss rate of the toner not containing the flat pigment.

9. The image forming apparatus according to claim 8, wherein at least one of the average charge amount per particle of toner and a transfer current flowing between the latent image carrier of the second image forming portion and the toner image carrier or the recording medium is set so as to satisfy Sm>Sc.

* * * * *